US005112550A

United States Patent [19]

Gotoh et al.

[11] Patent Number: 5,112,550

[45] Date of Patent: May 12, 1992

[54] PROCESS AND APPARATUS FOR PRODUCING SUPERFINE FIBERS

[75] Inventors: Masumi Gotoh; Tadayosi Sakurai, both of Tsuruga, Japan

[73] Assignee: Toyo Boseki Kabushiki Kaisha, Osaka, Japan

[21] Appl. No.: 694,482

[22] Filed: May 2, 1991

[30] Foreign Application Priority Data

May 11, 1990 [JP] Japan ..... 2-122504

[51] Int. Cl.[5] ..... D01D 4/02

[52] U.S. Cl. ..... 264/211.14; 264/176.1; 425/72.2; 425/463; 425/464

[58] Field of Search ..... 264/176.1, 211.14; 425/72.2, 378.2, 382.2, 463, 464

[56] References Cited

U.S. PATENT DOCUMENTS

| | | | |
|---|---|---|---|
| 2,969,561 | 1/1961 | McCormick et al. | 425/382.2 |
| 3,311,688 | 3/1967 | Schuller | 425/382.2 |
| 4,153,409 | 5/1979 | Capps et al. | 425/464 |

*Primary Examiner*—James Lowe

[57] ABSTRACT

A novel spinneret for producing superfine fibers having a total denier of not less than 20 denier and a monofilament denier of not more than 1.1 denier when winding up upon spinning is disclosed. The spinneret has nozzle orifices arranged in a lattice pattern extending toward a quench direction and the right angled direction to the quench direction. The arrangement is provided so as to satisfy the following formulas (1) to (4):

$$(1/5)D \leqq P_i(P-1) \leqq (\tfrac{1}{2})D \quad (1)$$

$$(\tfrac{1}{2})D \leqq Q_i(Q-1) \leqq D \quad (2)$$

$$Q_i/P_i \leqq 2 \quad (3)$$

$$Q(P-1) \leqq H \leqq P \times Q \quad (4)$$

wherein D is an effective diameter of the spinneret (mm), $P_i$ is a nozzle orifice pitch in the quench direction (mm), P is the maximum number of nozzle orifices arranged in the quench direction, $Q_i$ is a nozzle orifice pitch in the right angled direction to the quench direction (mm), Q is the maximum number of nozzle orifices arranged in the right angled direction to the quench direction and H is a total number of the orifices.

4 Claims, 1 Drawing Sheet

PROCESS AND APPARATUS FOR PRODUCING SUPERFINE FIBERS

FIELD OF THE INVENTION

The invention relates to a process for producing superfine fibers. More particularly, it relates to a process for stably spinning superfine fibers of a thermoplastic polymer. The present invention also relates to a spinneret for spinning superfine fibers of a thermoplastic polymer.

BACKGROUND OF THE INVENTION

Superfine fibers of a thermoplastic polymer such as polyester, nylon or the like have been used for the production of products having high added value. Particularly, fibers of not more than 0.5 monofilament denier have been used for the production of artificial leather, high-class clothes and the like.

Upon producing such superfine fibers, in general, a molten thermoplastic polymer is extruded from a spinneret, the extrudate is quenched by cooling air flowing in a direction across the extrudate, and then the extrudate is stretched to obtain multifilaments. As described above, the superfine fibers are requested to have not more than 0.5 monofilament denier. On the other hand, the fineness of multifilament yarns made of the monofilaments is requested to be not less than 20 denier like normal filament yarns. Therefore, it is required to use a spinneret having a lot of nozzle orifices in the production of superfine fibers. Then, quenching of filaments with the above cooling air tends to become ununiform and physical properties of respective filaments vary, which causes trouble such as filament breaking or the like, frequently. This is a significant problem from the operational viewpoint.

Then, various studies have been done to solve this problem. For example, JP-A 54-64119, JP-A 54-73915, JP-A 54-30924 and JP-A 54-88316 disclose technique for improving spinning stability from the viewpoints of a diameter of a nozzle orifice bored through a spinneret, an extrusion rate, a density of orifices, a minimum orifice interval, a wind-up rate and the like.

However, when the number of orifices of a spinneret is increased according to the above technique, difference in solidification of filaments by quenching is caused at orifices located in a leeward side of cooling air (hereinafter referred to as counter-quench side) among the orifices arranged on the nozzle and, therefore, filament breaking or the like during stretching is caused due to variation of crystallinity or orientation. Even if filament breaking is not caused, difference in physical properties of filaments is caused due to difference in the above quenching conditions between orifices located in a windward side of cooling air (hereinafter referred to as quench side) and the counter-quench side, which results in the cause of trouble not only in the spinning step but also in subsequent steps.

OBJECTS OF THE INVENTION

The main object of the present invention is to provide a process for producing superfine fibers wherein multifilaments having low monofilament denier can be stably spun using one spinneret with minimizing difference in physical properties of monofilaments due to difference in quenching conditions after spinning.

This object as well as other objects and advantages of the present invention will become apparent to those skilled in the art from the following description with reference to the accompanying drawings.

SUMMARY OF THE INVENTION

Figure 1:
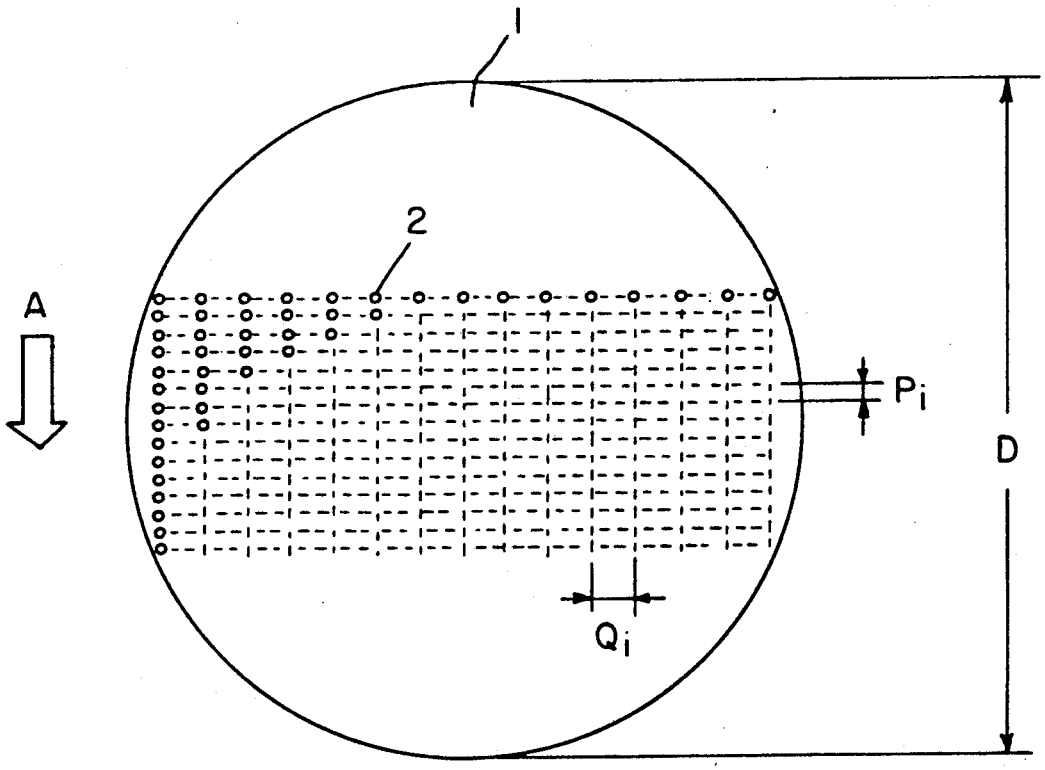
FIG. 1 is a schematic diagram illustrating one embodiment of a nozzle orifice arrangement of the spinneret of the present invention.

According to the present invention, there is provided a process for producing superfine fibers having a total denier of not less than 20 denier and a monofilament denier of not more than 1.1 denier when winding up upon spinning comprises using a spinneret having nozzle orifices arranged in a lattice pattern extending toward a quench direction and the right angled direction to the quench direction, said arrangement being provided so as to satisfy the following formulas (1) to (4):

$$(1/5)D \leqq P_i(P-1) \leqq (\tfrac{1}{2})D \quad (1)$$

$$(\tfrac{1}{2})D \leqq Q_i(Q-1) \leqq D \quad (2)$$

$$Q_i/P_i \geqq 2 \quad (3)$$

$$Q(P-1) \leqq H \leqq P \times Q \quad (4)$$

wherein D is an effective diameter of the spinneret (mm), $P_i$ is a nozzle orifice pitch in the quench direction (mm), P is the maximum number of nozzle orifices arranged in the quench direction, $Q_i$ is a nozzle orifice pitch in the right angled direction to the quench direction (mm), Q is the maximum number of nozzle orifices arranged in the right angled direction to the quench direction and H is a total number of the orifices. The present invention is also provide the spinneret for the production of superfine fibers.

DETAILED DESCRIPTION OF THE INVENTION

The present inventors have aimed at the fact that physical properties of filaments extruded from a spinneret at a quench side are different from those of filaments extruded at the counter-quench side depending upon quenching conditions, and have found that, if nozzle orifices can be arranged properly, quenching effect at a quench side becomes equal to that of the counter-quench side to obtain uniform physical properties of filaments. Then, the present inventors have studied to find out such a proper arrangement of nozzle orifices of a spinneret and attained to the present invention.

The present invention illustrates by using the accompanying FIG. 1.

FIG. 1 is a schematic diagram illustrating a typical embodiment of the nozzle orifice arrangement of the spinneret according to the present invention.

As seen from FIG. 1, nozzle orifices 2 of the spinneret 1 of the present invention are arranged in a lattice pattern extending toward a quench direction A and the right angled direction to the quench direction so that a orifice pitch in the right angled direction to the quench direction $Q_i$ is twice or more greater than an orifice pitch in the quench direction $P_i$. Therefore, passing of cooling air through among orifices is improved and, even if a density of orifices toward the quenching direction becomes higher, a uniform quenching effect can be obtained.

Thus, in the present invention, the arrangement should satisfy the relation of the parameters as defined by the formulas (1) to (4). The reasons are set forth below.

$$(1/5)D \leqq P_i(P-1) \leqq (\tfrac{1}{2})D \quad (1)$$

In this formula, $P_i(P-1)$ represents the length of a range in which nozzle orifices are formed toward the quench direction. When $P_i(P-1)$ is less than 1/5 of a spinneret effective diameter D, the number of nozzle orifices becomes too small and it is undesirable. When it exceeds ½, the quenching efficiency at the terminal end of the quench direction becomes inferior and quenching at the counter-quench side becomes insufficient, which results in the cause of filament braking at just below the spinneret. Therefore, $Pi(P-1)$ should be within the range between (1/5)D and (½)D.

$$(1/2)D \leqq Q_i(Q-1) \leqq D \quad (2)$$

In this formula, $Q_i(Q-1)$ represents the length of a range in which nozzle orifices are formed toward the right angled direction to the quench direction. The upper limit of $Q_i(Q-1)$ is the same as the spinneret effective diameter D. When it is less than (½)D, the number of orifices should be decreased. In order to provide the desired number of orifices, the orifice pitch should be decreased and passing of cooling air is extremely obstructed. Therefore, the range should be between (½)D and D.

$$Q_i/P_i \leqq 2 \quad (3)$$

When $Q_i/P_i$ is less than 2, a lot of orifices can be formed. However, quenching effect becomes extremely inferior, and filament breaking occurs frequently. Therefore it should be not less than 2.

$$Q(P-1) \leqq H \leqq P \times Q \quad (4)$$

The total number of orifices H is normally P x Q. However, all of the nozzle orifices are not always necessary depending upon the required number of filaments. In such a case, when a part of the nozzle orifices in one row which is at right angles to the quench direction is not formed, the total number of orifices H can be adjusted with maintaining uniform quenching conditions of filaments.

The process for producing superfine fibers can be conducted according to a conventional manner by using the spinneret.

The thermoplastic polymer which can be used in the present invention may be those applicable to melt-spinning and examples thereof include polyester, polyamide, polyolefine and the like. Further, modifiers, dulling agents and the like may be appropriately added to the polymer.

As described above, the present invention is characterized by improving arrangement of the nozzle orifices and, therefore, superfine fibers of a thermoplastic polymer can be stably spun and, at the same time, spinning operation of superfine fibers can be extremely improved.

The following Examples and Comparative Examples further illustrate the present invention in detail but are not to be construed to limit the scope thereof.

EXAMPLE 1

Polyethylene terephthalate having an intrinsic viscosity of 0.6 was extruded through a spinneret having the spinneret effective diameter of 90 mm ϕ, the pitch and the number of orifices as shown in Table 1 at the rate of 0.15 g/minute per one nozzle orifice at the spinning temperature of 290° C. and wound up at the rate of 3,000 m/minute. Then, the resulting extrudate was stretched by a conventional stretching method to obtain finished filaments of 0.3 monofilament denier. The frequency of filament breaking are also shown in Table 1.

TABLE 1

| Sample No. | D (mmϕ) | Quench direction Pi (mm) | P | Pi · (P-1) | Right angled direction Qi (mm) | Q | Qi · (Q-1) | Qi/Pi | Density of orifices (per 1 cm²) | Total number of orifices H | Total denier (d) | Frequency of filament breaking per day · Pos | |
|---|---|---|---|---|---|---|---|---|---|---|---|---|---|
| 1 | 90 | 2.5 | 16 | 37.5 | 6.0 | 14 | 78.0 | 2.4 | 7.5 | 220 | 66 | 0.05 | Example |
| 2 | 90 | 2.0 | 17 | 32.0 | 6.5 | 13 | 78.0 | 3.25 | 8.8 | 220 | 66 | 0.02 | |
| 3 | 90 | 2.5 | 17 | 40.0 | 6.0 | 13 | 72.0 | 2.4 | 7.6 | 220 | 66 | 0.08 | |
| 4 | 90 | 2.0 | 11 | 20.0 | 4.0 | 20 | 76.0 | 2.0 | 14.5 | 220 | 66 | 0.09 | |
| 5 | 90 | 2.0 | 17 | 32.0 | 6.5 | 7 | 39.0 | 3.25 | 8.8 | 110 | 33 | 0.01 | |
| 6 | 90 | 2.5 | 20 | 47.5 | 5.0 | 12 | 55.0 | 2.0 | 8.9 | 220 | 66 | 0.92 | Comparative |
| 7 | 90 | 2.0 | 9 | 16.0 | 4.0 | 20 | 76.0 | 2.0 | 14.8 | 180 | 54 | 0.90 | Example |
| 8 | 90 | 2.5 | 19 | 45.0 | 4.0 | 12 | 44.0 | 1.6 | 11.1 | 220 | 66 | 1.35 | |
| 9 | 90 | 2.0 | 22 | 42.0 | 4.4 | 11 | 44.0 | 2.2 | 11.9 | 220 | 66 | 2.50 | |
| 10 | 90 | 2.0 | 11 | 20.0 | 3.0 | 20 | 57.0 | 1.5 | 19.3 | 220 | 66 | 1.23 | |

In the Example (Sample Nos. 1 to 5) of the present invention, the spinneret satisfying all the above conditions (1) to (4) is used and, therefore, the frequency of filament breaking is less than 0.1 per day and superior operating efficiency can be obtained.

On the other hand, Sample Nos. 6 to 10 are the Comparative Example wherein at least one of the above conditions (1) to (4) is not satisfied and the frequency of filament breaking is high. Thus, spinning operating efficiency is inferior. Sample No. 6 is the Comparative Example wherein $P_i(P-1)$ is larger than the above conditions. Sample No. 7 is the Comparative Example wherein $P_i(P-1)$ is smaller than the above conditions, and the frequency of filament breaking is high because the nozzle orifices are concentrated in the center thereof. Sample No. 8 is the Comparative Example wherein both $Q_i(Q-1)$ and $Q_i/P_i$ are smaller than the above conditions, and the frequency of filament breaking is extremely high. Sample No. 9 is the Comparative Example wherein $Q_i(Q-1)$ is smaller than the extremely high. Sample No. 10 is the Comparative Example wherein $Q_i/P_i$ is smaller and the density of orifices is larger, and the frequency of filament breaking is high.

EXAMPLE 2

Nylon 6 having relative viscosity of 2.5 was extruded through a spinneret having the spinneret effective diameter of 60 mm ϕ, the pitch and the number of orifices as shown in Table 2 at the rate of 0.25 g/minute per one nozzle orifice at the spinning temperature of 275° C. and the extrudate was taken off at a rate of 5,000 m/minute and stretched without winding up to obtain finished filaments of 0.5 monofilament denier. The frequency of filament breaking are also shown in Table 2.

TABLE 2

| Sample No. | D (mmϕ) | Quench direction Pi (mm) | P | Pi · (P-1) | Right angled direction Qi (mm) | Q | Qi · (Q-1) | Qi/Pi | Density of orifices | Total number of orifices H | Total denier (d) | Frequency of filament breaking per day · Pos | |
|---|---|---|---|---|---|---|---|---|---|---|---|---|---|
| 11 | 60 | 2.0 | 12 | 22.0 | 7.0 | 9 | 56.0 | 3.25 | 8.8 | 108 | 54 | 0.16 | Example |
| 12 | 60 | 2.5 | 8 | 17.5 | 4.0 | 14 | 52.0 | 1.6 | 11.9 | 108 | 54 | 1.55 | Comparative Example |
| 13 | 60 | 2.5 | 14 | 32.5 | 5.0 | 8 | 35.0 | 2.0 | 9.5 | 108 | 54 | 2.10 | Comparative Example |

Sample No. 11 satisfies all the conditions of the present invention and, therefore, the frequency of filament breaking is low. On the other hand, Sample Nos. 12 and 13 are the Comparative Examples wherein $Q_i/P_i$ is small and $P_i(P-1)$ is large. In both samples of the Comparative Examples, the frequency of filament breaking is extremely high.

EXAMPLE 3

Polyethylene terephthalate having an intrinsic viscosity of 0.6 was extruded through a spinneret having the spinneret effective diameter of 60 mm ϕ, the pitch and the number of orifice as shown in Table 3 at the rate of 0.16 g/minute per one nozzle orifice at the spinning temperature of 290° C. and the extrudate was taken off at the rate of 5,000 m/minute and then stretched without winding up to obtain finished filaments having 0.25 monofilament denier. The frequency of filament breaking are also shown in Table 3.

TABLE 3

| Sample No. | D (mmϕ) | Quench direction Pi (mm) | P | Pi · (P-1) | Right angled direction Qi (mm) | Q | Qi · (Q-1) | Qi/Pi | Density of orifices (per 1 cm²) | Total number of orifices H | Total denier (d) | Frequency of filament breaking per day · Pos | |
|---|---|---|---|---|---|---|---|---|---|---|---|---|---|
| 21 | 60 | 2.0 | 12 | 22.0 | 7.0 | 9 | 56.0 | 3.25 | 8.8 | 108 | 27 | 0.55 | Example |
| 22 | 60 | 2.5 | 8 | 17.5 | 4.0 | 14 | 52.0 | 1.6 | 11.9 | 108 | 27 | 4.5 | Comparative Example |
| 23 | 60 | 2.5 | 14 | 32.5 | 5.0 | 8 | 35.0 | 2.0 | 9.5 | 108 | 27 | a lot of filament breaking is caused | Comparative Example |

Sample No. 21 satisfies all the conditions of the present invention and, therefore, the frequency of filament breaking is low. On the other hand, Sample Nos. 22 and 23 are the Comparative Examples wherein $Q_i/P_i$ is low and $P_i(P-1)$ is large. In both samples of the Comparative Examples, filament breaking occurs frequently and spinning operating efficiency is extremely inferior.

As is seen from the results of the Examples (Sample Nos. 2 and 3), superfine fibers can be stably produced even in high-speed spinning by using the spinneret of the present invention.

What is claimed is:

1. A process for producing superfine fibers having a total denier of not less than 20 denier and a monofilament denier of not more than 1.1 denier when winding up upon spinning comprises using a spinneret having nozzle orifices arranged in a lattice pattern extending toward a quench direction and the right angled direction to the quench direction, said arrangement being provided so as to satisfy the following formulas (1) to (4):

$$(1/5)D \leqq P_i(P-1) \leqq (\tfrac{1}{2})D \quad (1)$$

$$(\tfrac{1}{2})D \leqq Q_i(Q-1) \leqq D \quad (2)$$

$$Q_i/P_i \geqq 2 \quad (3)$$

$$Q(P-1) \leqq H \leqq P \times Q \quad (4)$$

wherein D is an effective diameter of the spinneret (mm), $P_i$ is a nozzle orifice pitch in the quench direction (mm), P is the maximum number of nozzle orifices arranged in the quench direction, $Q_i$ is a nozzle orifice pitch in the right angled direction to the quench direction (mm), Q is the maximum number of nozzle orifices arranged in the right angled direction to the quench direction and H is a total number of the orifices.

2. A process according to claim 1, wherein the monofilament denier of the superfine fibers is not more than 0.5 denier.

3. A spinneret for producing superfine fibers having a total denier of not less than 20 denier and a monofilament denier of not more than 1.1 denier when winding up upon spinning which has nozzle orifices arranged in a lattice pattern extending toward a quench direction and the right angled direction to the quench direction, said arrangement being provided so as to satisfy the following formulas (1) to (4):

$$(1/5)D \leqq P_i(P-1) \leqq (\tfrac{1}{2})D \quad (1)$$

$$(\tfrac{1}{2})D \leqq Q_i(Q-1) \leqq D \quad (2)$$

$$Q_i/P_i \geqq 2 \quad (3)$$

$$Q(P-1) \leqq H \leqq P \times Q \quad (4)$$

wherein D is an effective diameter of the spinneret (mm), $P_i$ is a nozzle orifice pitch in the quench direction (mm), P is the maximum number of nozzle orifices arranged in the quench direction, $Q_i$ is a nozzle orifice pitch in the right angled direction to the quench direction (mm), Q is the maximum number of nozzle orifices arranged in the right angled direction to the quench direction and H is a total number of the orifices.

4. A spinneret according to claim 3 which is used for producing the superfine fibers having a monofilament denier of not more than 0.5 denier.

* * * * *